US006991020B1

(12) United States Patent
Cheng et al.

(10) Patent No.: US 6,991,020 B1
(45) Date of Patent: Jan. 31, 2006

(54) PULL DOWN, PUSH UP, SHADE ASSEMBLY

(75) Inventors: Li-Ming Cheng, Kaohsiung (TW); Lawrence S. Wu, Rowland Heights, CA (US)

(73) Assignee: ZipShade Industrial (B.V.I.) Corp., Ontario, CA (US)

( * ) Notice: Subject to any disclaimer, the term of this patent is extended or adjusted under 35 U.S.C. 154(b) by 0 days.

(21) Appl. No.: 10/360,305

(22) Filed: Feb. 10, 2003

(51) Int. Cl.
*E06B 9/30* (2006.01)

(52) U.S. Cl. ..... 160/168.1 R

(58) Field of Classification Search ..... 160/168.1 R, 160/173 R, 178.1 R, 344, 345, 84.04, 84.05, 160/84.06, 902; 248/262
See application file for complete search history.

(56) References Cited

U.S. PATENT DOCUMENTS

| | | | | |
|---|---|---|---|---|
| 1,949,653 | A * | 3/1934 | Moore | 160/170 |
| 2,267,160 | A * | 12/1941 | McKerlie | 248/264 |
| 2,594,637 | A * | 4/1952 | Gertzon | 160/168.1 R |
| 2,748,852 | A * | 6/1956 | Akerstrom | 160/168.1 R |
| 3,798,839 | A * | 3/1974 | Kaufman | 49/127 |
| 5,482,100 | A | 1/1996 | Kuhar | |
| 5,531,257 | A | 7/1996 | Kuhar | |
| 5,547,156 | A * | 8/1996 | Djuric | 248/307 |
| 5,671,793 | A * | 9/1997 | Lee | 160/168.1 R |
| 5,813,447 | A | 9/1998 | Lysyj | |
| 6,012,506 | A | 1/2000 | Wang et al. | |
| 6,047,759 | A | 4/2000 | Lysyj | |
| 6,047,760 | A * | 4/2000 | Judkins | 160/168.1 R |
| 6,056,036 | A | 5/2000 | Todd et al. | |
| 6,164,362 | A * | 12/2000 | Yang | 160/84.04 |
| 6,289,965 | B1 | 9/2001 | Ruggles | |
| 6,293,329 | B1 | 9/2001 | Toti | |
| 6,330,899 | B1 | 12/2001 | Ciuca et al. | |
| 6,474,394 | B2 | 11/2002 | Kuhar | |
| 6,681,831 | B1 * | 1/2004 | Cheng et al. | 160/84.06 |

* cited by examiner

*Primary Examiner*—Blair M. Johnson
(74) *Attorney, Agent, or Firm*—William W. Haefliger

(57) ABSTRACT

A pleated shade assembly capable of height adjustment without use of pull cords, comprising an upper elongated support; a lower elongated member that is manually adjustable up and down; primary lines extending through shade pleats to suspend the bottom elongated member; primary rotors at the top elongated support to entrain the primary lines; at least one secondary line having operative connection to the primary lines; and apparatus acting on the secondary line or lines for counterbalancing suspension force exerted on the primary lines at different shade height adjusted levels.

15 Claims, 5 Drawing Sheets

PULL DOWN, PUSH UP, SHADE ASSEMBLY

BACKGROUND OF THE INVENTION

This invention relates generally to window shade control, and more particularly to simplification in raising and lowering pleated window shades without requiring manipulation of a cord or cords hanging downwardly from an upper support or rail member.

The use of hanging cords requiring manual manipulation has been thought to be required for the raising and lowering of window shades, and particularly pleated shades. Such cords are frequently difficult to operate correctly, and their use can result in inaccurate or unwanted shade movement, as well as risk of entanglement with small children, and possible strangulation. There is need for a cordless and pleated window shade assembly which can be easily operated as by simply exerting up or down light force on the lower hanging portion of the assembly.

There is also need for a pleated window shade assembly that is easily operated, and can be automatically kept level, upon adjustment at one location.

SUMMARY OF THE INVENTION

It is a major object of the invention to provide apparatus and method of operation, meeting the above needs. Basically, the invention is embodied in a pleated shade assembly capable of height adjustment without use of pull cords, comprising, in combination:

a) an upper elongated support,
b) a lower elongated member that is manually adjustable up and down,
c) primary lines extending through shade pleats to suspend the lower elongated member,
d) primary rotors at the upper elongated support to entrain the primary lines,
e) at least one secondary line having operative connection to the primary lines,
f) and tensioning means acting on that secondary line or lines for counterbalancing suspension force exerted on the primary lines at different shade height adjusted levels.

It is another object of the invention to provide a rotary member exerting tensioning force on the secondary line or lines; to provide a rotary member exerting tensioning force on that secondary line or lines; and to provide a number of such secondary line or lines less than the number of said primary lines, whereby, the rotary member of small dimension is able to controllably store a maximum number of windings, within the confines of a reduced dimension upper support member, such as a channel configured rail.

It is yet another object of the invention to provide a path of travel for the defined line connection or interconnection, which extends lengthwise of the upper support, and which does not pass over any rotors, and whereby possible derailment of that connection by a rotor is prevented. In this respect, the primary rotors preferably include a first rotor having spacing from said counterbalancing means which exceeds said path of travel, for shade height adjustment between uppermost and lowermost positions.

Further, the primary rotors may typically include at least one second rotor over which said primary lines are entrained, and the primary rotors including a third rotor in the form of a pulley over which one of the primary lines is entrained, and a fourth rotor in the form of a pulley over which another of the primary lines is entrained.

Yet another object includes containment by the upper support of all of the primary rotors and the tensioning means; the provision of primary lines that have first terminals operatively connected to said lower elongated member, below said upper support; and wherein the primary lines have second terminals operatively connected to said connection, within said upper support.

A further object is to provide a tensioning means that includes a device for locking said secondary line in a selected position or positions corresponding to selected shade height adjustment. In this regard, the secondary line may have an extension that hangs below the level of said device, for manual grasping and control of locking by said device.

An additional object is provision of a fastener or fasteners to attach the upper elongated support to structure above the levels of said rotors and secondary line, said fastener or fasteners being one of the following:

i) a spacer portion to positively locate the elongated support spaced below said structure,
ii) a hinged portion to positively locate the elongated support below upright wall to which the hinged portion is attachable.

These and other objects and advantages of the invention, as well as the details of an illustrative embodiment, will be more fully understood from the following specification and drawings, in which:

DRAWING DESCRIPTION

DETAILED DESCRIPTION

Figure 1:
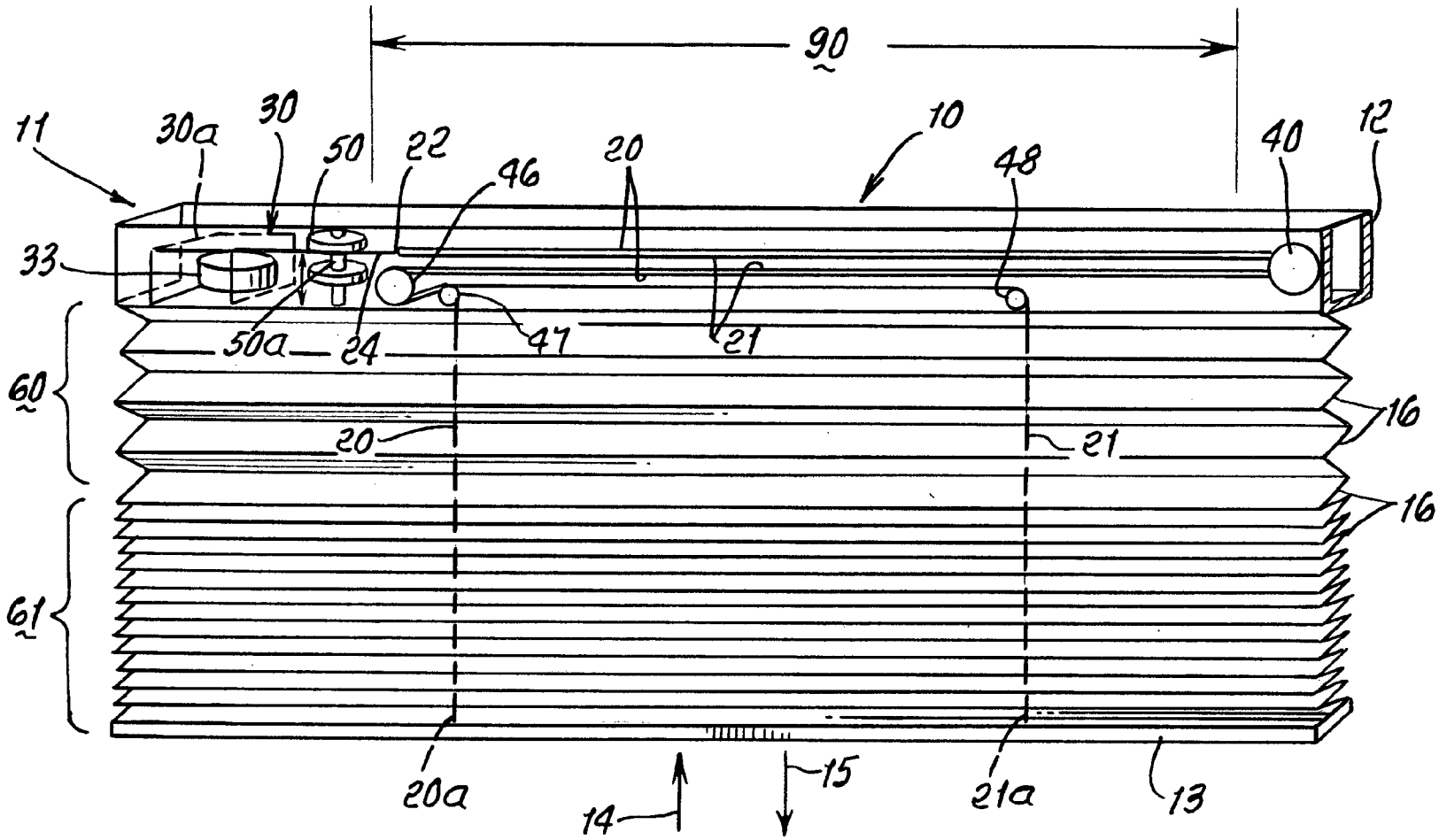
FIG. 1 is an elevational view of an improved shade assembly incorporating the invention.
Figure 3:
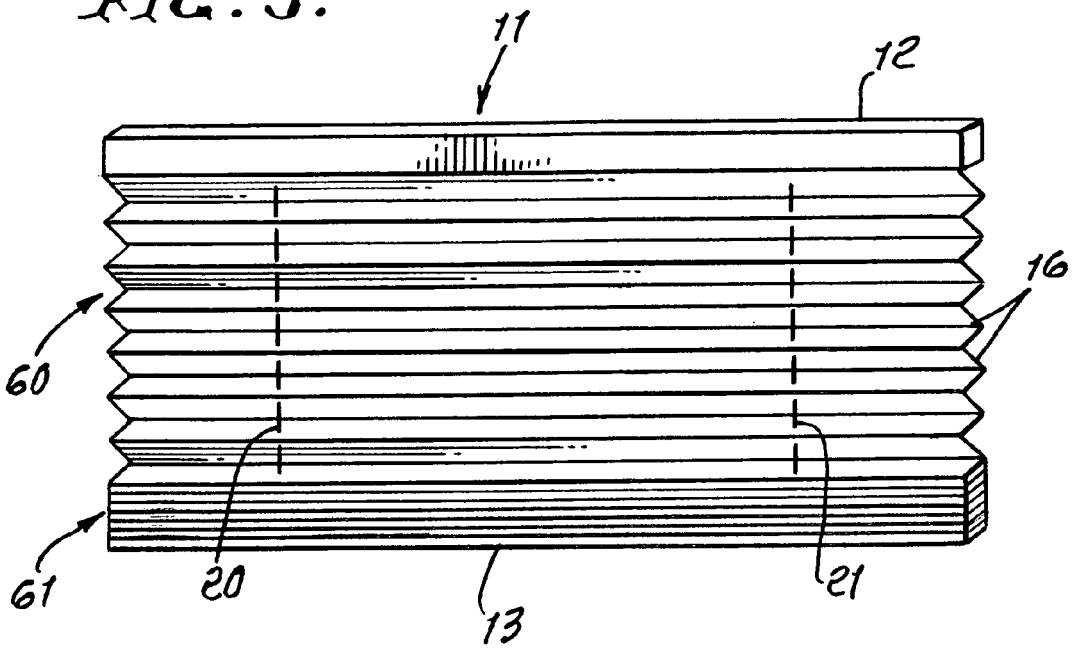
FIG. 3 is a view like FIG. 1, showing the assembly of the invention, no external pull cords being visible.
Figure 2:
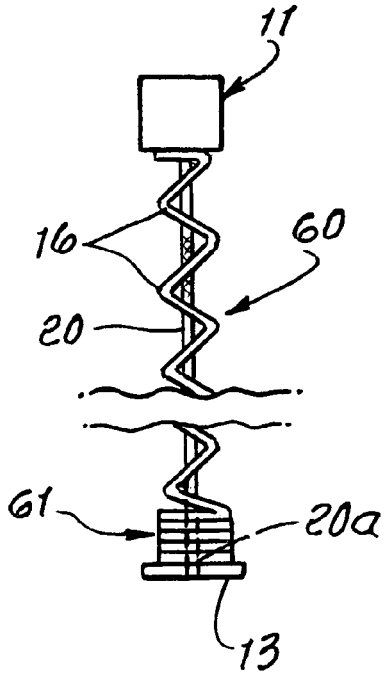
FIG. 2 is an end view of the shade assembly.

In FIGS. 1 and 2, a preferred pleated shade assembly 10 is capable of height adjustment without use of external pull cords. It includes an upper elongated support 11 which may be in the form of a metallic channel or rail 12 which may be otherwise hollow. The assembly also includes a lower elongated slat member 13 that is to be simply manually adjusted up or down, as indicated by arrows 14 and 15. Shade pleats 16 are located between and connected to 12 and 13, as shown. The pleats are foldable, and expand or separate as member 13 is urged downwardly, to selectively adjusted height position, for example controllably covering a window. See for example FIG. 2. The pleats collapse toward one another as the member 13 is elevated toward 12, to another adjusted position or positions. Pleats expand as at 60, from stacked positions as at 61. See also FIG. 2.

Primary lines or cords are provided to extend generally vertically through the pleats, as seen in FIG. 2, to suspend the lower member 13. See for example two lines 20 and 21, connected at their lower ends or terminals 20*a* and 21*a* to member 13, at laterally spaced positions. Two such lines are shown, but three may be provided, as for a larger width shade.

Primary rotors are provided at the upper support or rail 11, to entrain the primary lines, and guide them toward a common connection 22 with at least one secondary line 24 which moves endwise relative to 12 as connection 22 is moved endwise. The number of secondary lines is less than the number of primary lines, for reasons as will appear. Typically, there is only one secondary line 24, and two or more primary lines, such as lines 20 and 21. In that event, connection 22 connects the terminals of lines 20 and 21 with the terminal of line 24, whereby movement of that connection 22 and line 24 in one direction tends to equally raise primary line terminals 20*a* and 21*a*; and movement of connection 22 and line 24 in the opposite direction tends to equally lower primary line terminals 20*a* and 21*a*, the lower member thereby being maintained in horizontal condition as it is raised and lowered.

Figure 4:
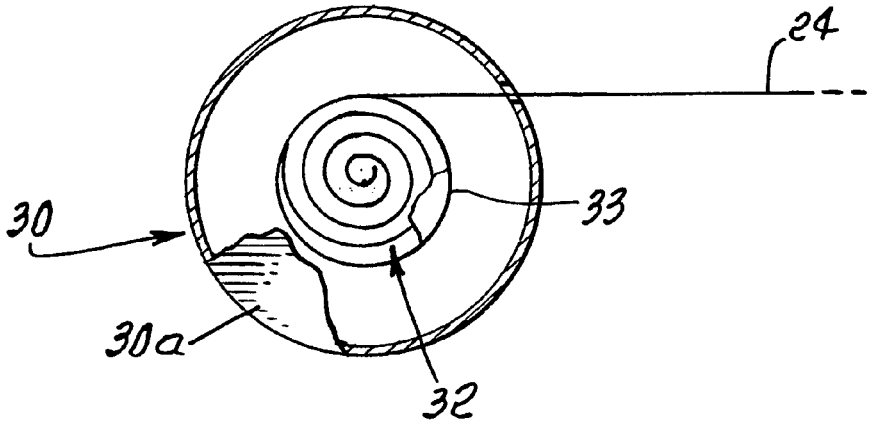
FIG. 4 is a view showing components of a line tensioner means.

Means is provided for acting on the secondary line or lines 24 for exerting force counterbalancing the suspension force exerted on the primary lines, by the weight of the lower member 13, and pleats, as at different shade height adjusted levels. Such counterbalancing force enables stable suspension of the lower member 13 at any vertical position to which it is raised or lowered. Such means is generally indicated at 30 in FIGS. 1 and 4 and may take different forms, but preferably enabling its reception as shown within the confining channel shaped support 11, as near one end thereof. Means 30 may include a housing 30*a*, and a tension exerting torsion spring element 32 within 30*a*. The line 24 is typically wound onto or off a spool or drum 33 within 30*a*, and spring force is exerted on the spool in a line winding direction, to provide the counterbalancing force or tension referred to. That force is maintained as the shade is raised or lowered to stable adjusted position, and static friction may be provided in the means 30 acting to hold the lower member at selected height adjustment. Such friction may be supplied by drum 32 rubbing against the housing. Since only one line 24 is typically spooled at 33, the size of the spool may be minimized to fit within channel 12. A guide pulley 50 directs travel of line 24 to and from the winding area of the spool. Pulley 50 is axially slidable along axle 50*a*, perpendicular to line 24, to follow or guide the line 24 as it is wound on and off drum 33.

In the primary rotor system illustrated a first rotor 40 may have spacing from the tensioning means 30 such that the lengthwise path of travel indicated by dimension 90 of connection 22 does not pass over any primary rotor, or pulleys, such as first rotor 40, thereby eliminating risk of entanglement or "hang-up" of connection 22 with rotor structures. In this regard, first rotor 40 is shown as having spacing from said means 30 which exceeds said path of travel, for shade height adjustment between uppermost and lowermost positions.

As shown, the primary rotors include at least one second rotor over which said primary lines are entrained, and the primary rotors include a third rotor in the form of a pulley over which one of said primary lines is entrained, and a fourth rotor in the form of a pulley over which another of said primary lines (line 21) is entrained.

See for example the following:

second rotor 46, (for example near 50)

third rotor 47 fourth rotor 48.

All of such rotors are contained within the channel shaped support 11. Lines 20 and 21 project downwardly through lower extent of support 11. Rotor 46 is between 50 and 47, so that both lines 20 and 21 may be redirected by like idler rotors 47 and 48, for like vertical control of lines 20 and 21, enhancing maintenance of slat 13 in horizontal condition.

Figure 5:
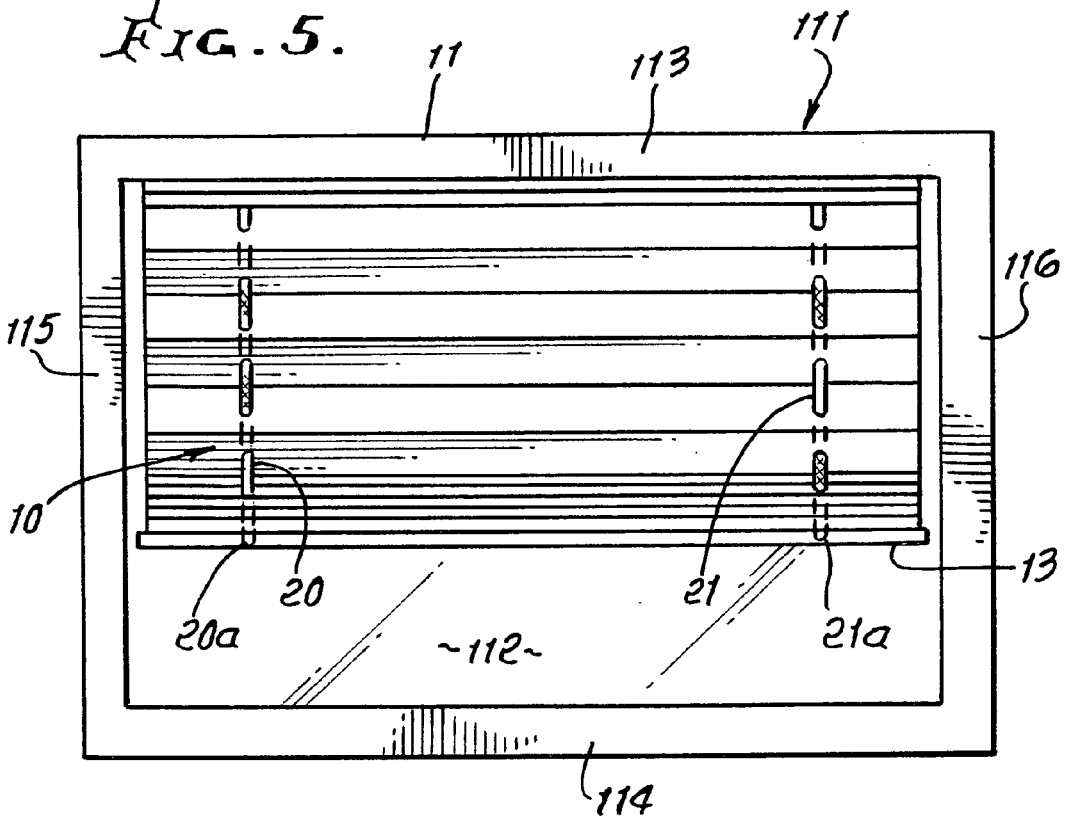
FIG. 5 is an elevation showing a window frame, with the device of the invention located at the window.

In FIG. 5, the assembly or apparatus 10 is installed at a window 112 bordered by a frame 111. The latter has horizontal and vertical frame members 113–116, as shown. Support 11 is attached to upper horizontal frame member 113.

Figure 6:
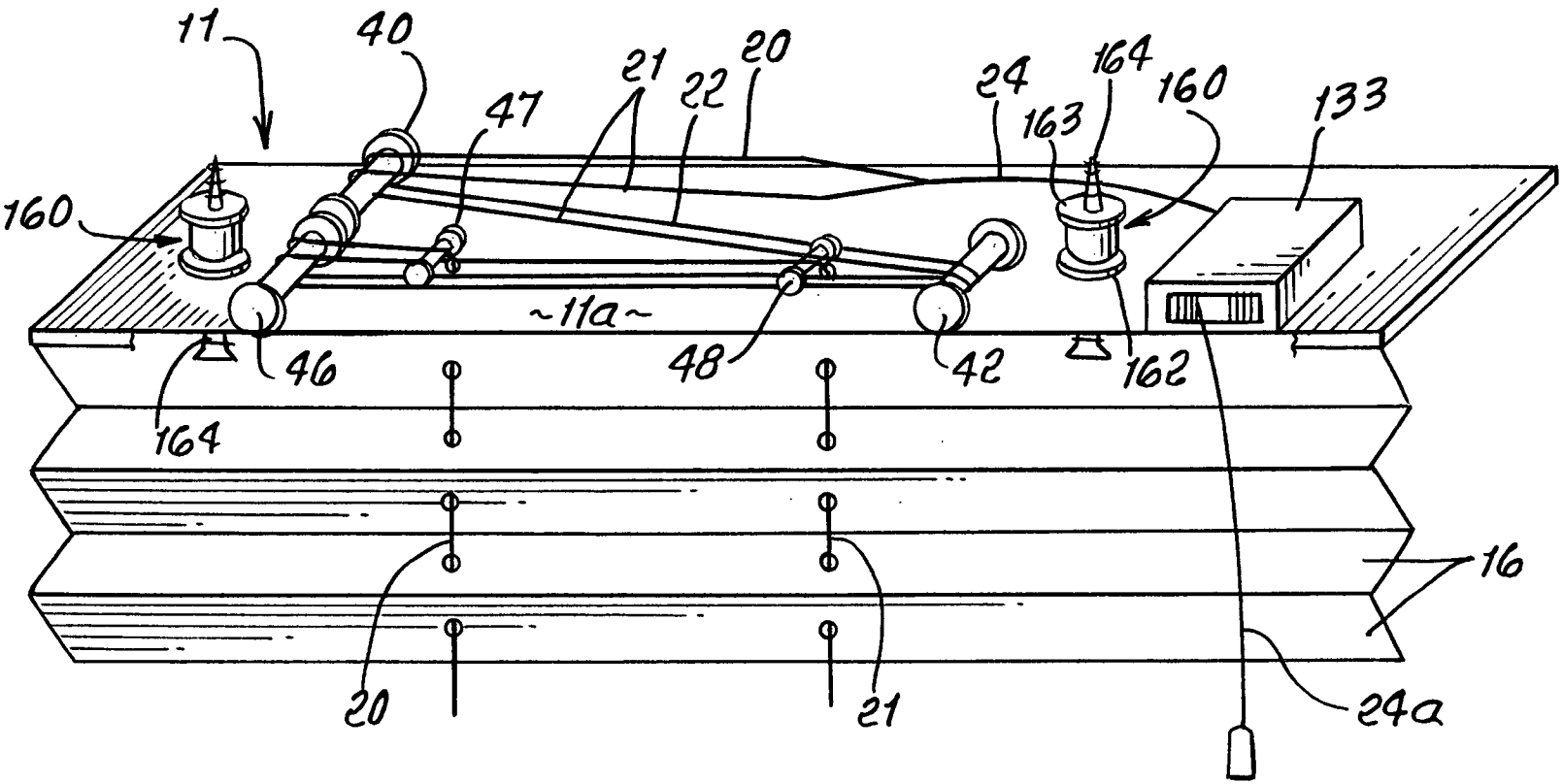
FIG. 6 is a schematic perspective view of a modification.

Referring now to the modification seen in FIG. 6, elements corresponding to elements of FIG. 1 are given corresponding identification numerals. In FIG. 6, rotors 40 and 46 are located at the same general position along 11; and this is enabled by providing an idler rotor 42 carried by 11, and over which primary lines 20 and 21 extend or are entrained, as shown. Idler rollers or rotors 47 and 48 are located along the length of 11, and between 42 and 46.

Secondary line 24 extends to the means 133 acting on 24 for resisting suspension force exerted on the primary lines 20 and 21, as at different shade height adjustment levels. In this instance, the means 133 is a device for locking the secondary line 24 in a selected position or positions corresponding to selected shade height adjustment. In this example, line 24 has an extension 24*a* that hangs below the level of said device, for manual grasping and control of locking by said device. The user can control the locking or unlocking status of means 133 by varying the angularity of pull on single line 24*a*, and thereby control the positions of two lines 20 and 21 that control shade height and bottom level.

In accordance with an additional feature or features of the invention, a fastener or fasteners is or are provided to attach the upper elongated support to structure above the levels of said rotors and secondary line, said fastener or fasteners being one of the following:

i) a spacer portion to positively locate the elongated support spaced below said structure, ii) a hinged portion to positively locate the elongated support below upright wall to which the hinged portion is attachable.

Figure 7:
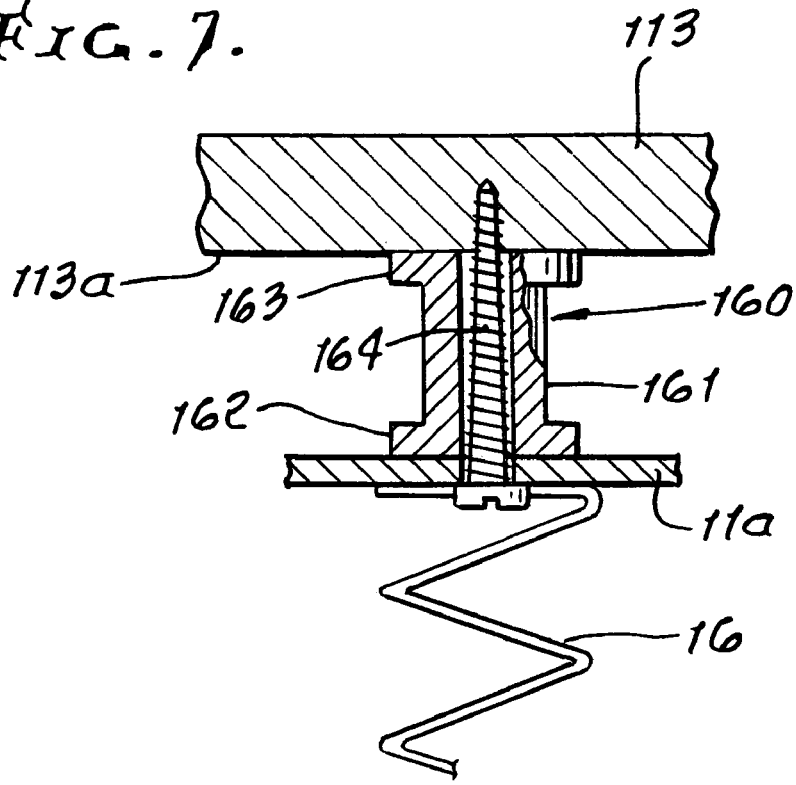
FIG. 7 is an enlarged end view upper extent of the FIG. 6 modification.

FIGS. 6 and 7 show two such fasteners 160 having middle spacer portion 161 to positively locate elongated support lower wall 11*a* at a predetermined fixed distance below the window frame upper member 113. For this purpose, a lower flange 162 on 160 engages lower wall 11*a*, and an upper flange 163 on 160 engages the underside 113*a* of member 113. A retainer screw 164 extends through 160 and connects to 113.

Figure 8:
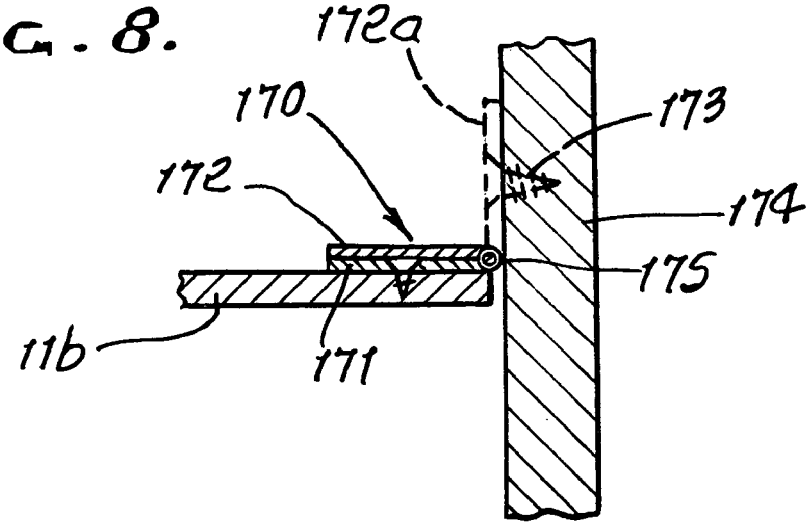
FIG. 8 is an end view of a modified attachment of the upper elongated member of the apparatus, to a wall.

In FIG. 8, the illustrated hinged portion 170 has a first component 171 to attach to the upper wall 11*b* of the elongated support; and a second component 172 to swing upwardly and attach by fastener or fasteners 173 to upright wall 174 on or near the window frame.

Components 171 and 172 are hingedly connected together at 175 to form an L-shaped positive support when 172 is swung upwardly to position 172*a*.

What is claimed is:

1. A collapsible shade assembly having shade means capable of height adjustment comprising, in combination:

a) an upper elongated support, b) a lower elongated member that is manually adjustable up and down, c) primary lines extending through said shade means to suspend said bottom elongated member, d) primary rotors on said top elongated support, each rotor on said upper elongated support entraining and reversing line directions of travel of said primary lines, e) at least one secondary line being connected to said primary lines, f) and means acting on said secondary line or lines for resisting suspension force exerted on said primary lines at different shade means height adjusted levels, g) said primary rotors comprising pulleys, said connection of said primary and secondary lines being located, between said pulleys and said acting means and at a position on a section of said secondary line that has not passed over any pulley reversing the direction of the secondary line or said section thereof leading to a hoisting cord, whereby said connection at all times remains spaced from such pulleys, during shade means height adjustment between uppermost and lowermost positions, h) and said acting means being located on said upper elongated support and comprising a device for locking said secondary line in a selected position or positions corresponding to selected shade means height adjustment.

2. The assembly of claim 1 wherein the number of said secondary line or lines is less than the number of said primary lines.

3. The assembly of claim 1 wherein there is only one secondary line.

4. The assembly of claim 1 wherein there is only one secondary line, and there are 2 or 3 of said primary lines.

5. The assembly of claim 1 wherein said primary rotors include a first rotor having spacing from said acting means which exceeds said path of travel for shade height adjustment between uppermost and lowermost positions.

6. The assembly of claim 5 wherein said primary rotors include at least one second rotor over which said primary lines are entrained, and said primary rotors include a third rotor in the form of a pulley over which one of said primary lines is entrained, and a fourth rotor in the form of a pulley over which another of said primary lines is entrained.

7. The assembly of claim 6 wherein said upper elongated support protectively contains all of said primary rotors and said tensioning means.

8. The assembly of claim 1 wherein said primary lines have first terminals operatively connected to said lower elongated member, below said upper support.

9. The assembly of claim 1 wherein said secondary line has an extension that hangs below the level of said device, for manual grasping and control of locking by said device.

10. The assembly of claim 1 wherein the number of said secondary line or lines is less than the number of said primary lines.

11. The assembly of claim 1 wherein there is only one secondary line, and there are 2 or 3 of said primary lines.

12. The assembly of claim 1 including a fastener or fasteners to attach the upper elongated support to structure above the levels of said rotors and secondary line, said fastener or fasteners being one of the following:

i) a spacer portion to positively locate the elongated support spaced below said structure, ii) a hinged portion to positively locate the elongated support below upright wall to which the hinged portion is attachable.

13. The assembly of claim 12 wherein said spacer portion has upper and lower locating flanges thereon.

14. The assembly of claim 12 wherein said hinged portion has a first component to attach to the elongated support, and a second component to attach to said upright wall, said components being hingedly connected.

15. A pleated shade assembly capable of height adjustment without use of pull cords, comprising, in combination:

a) an upper elongated support, b) a lower elongated member that is manually adjustable up and down, c) primary lines extending through shade pleats to suspend said bottom elongated member, d) primary rotors on said top elongated support to, each rotor on said upper elongated support entraining and reversing line directions of travel of said primary lines, e) at least one secondary line being connected to said primary lines, f) and means acting on said secondary line or lines for resisting suspension force exerted on said primary lines at different shade pleat height adjusted levels, g) said primary rotors comprising pulleys, said connection, of said primary and secondary lines being located, between said pulleys and said acting means and at a position on a section of said secondary line characterized in that, for the main extent of its travel, said connection does not pass over any or pulley reversing the direction of said secondary line or said section thereof leading to a hoisting cord, whereby said connector at all times remains spaced from such pulleys during shade pleat height adjustment between uppermost and lowermost selected positions, h) and said acting means being located on said upper elongated support and comprising a device for locking said secondary line in a selected position or positions corresponding to selected shade height adjustment.

* * * * *